United States Patent [19]

McKelvey

[11] Patent Number: 4,893,943

[45] Date of Patent: Jan. 16, 1990

[54] METHOD AND APPARATUS FOR LOW FROTH AGITATION OF TANKED FLUIDS

[75] Inventor: John L. McKelvey, Lakeland, Fla.

[73] Assignee: The Ink Company, West Sacramento, Calif.

[21] Appl. No.: 212,268

[22] Filed: Jun. 27, 1988

[51] Int. Cl.[4] ..... B01F 7/16

[52] U.S. Cl. ..... 366/312

[58] Field of Search ..... 366/309, 311, 312, 313, 366/324, 325, 328, 329, 330, 279

[56] References Cited

U.S. PATENT DOCUMENTS

| | | | |
|---|---|---|---|
| 1,326,628 | 12/1919 | Anderson | 366/312 |
| 1,369,888 | 3/1921 | Pevney | 366/328 |
| 1,379,707 | 5/1921 | Croix | 366/303 |
| 1,698,402 | 1/1929 | Harris | 366/308 |
| 2,367,149 | 1/1945 | Smith | 366/309 |

*Primary Examiner*—Robert W. Jenkins

*Attorney, Agent, or Firm*—Stetina and Brunda

[57] ABSTRACT

Disclosed is an agitator apparatus for mixing tanked fluids while simultaneously wiping any adherent fluids from the tank wall. The device comprises a fluid agitating means rotationally mounted within the tank for mixing the fluid held therein. At least one tank wall wiper blade is attached to the fluid agitating means to skim or wipe fluid from the tank wall as rotational movement of the agitation means occurs. The agitation means may, in itself, comprise one or more perforated mixing panels attached to a rotating shaft member so as to effectively mix the fluid as the shaft member is rotated.

14 Claims, 1 Drawing Sheet

METHOD AND APPARATUS FOR LOW FROTH AGITATION OF TANKED FLUIDS

BACKGROUND OF THE INVENTION

This invention relates generally to a method and apparatus for agitating tanked fluids and more particularly to a combined fluid mixing and tank wall wiping device positionable within a fluid holding tank.

The invention is particularly applicable to use with flexographic printing ink systems and, accordingly, will be frequently described herein with particular reference to such systems. It must be appreciated, however, that the invention has much broader applicability and may find utility in the stirring and mixing of virtually any tanked fluid wherein it is desirable to avoid the formation of froth within the fluid mass or the buildup of dried fluid residues on the walls of the tank.

Various fluid agitators and mixers are well known in the art. In general, however, such devices fall short of providing an optimal means for maintaining physical and/or thermal homogeneity of a fluid while, at the same time, preventing the buildup and desiccation of the fluid on the walls of the tank One particular application wherein the above-described problems are encountered is in contemporary flexographic printing ink systems. Such ink systems generally utilize at least one ink conditioning tank wherein a quantity of ink is held. The viscosity of the ink within the conditioning tank is periodically adjusted through the addition of water. Thus, in order to maintain the desired viscosity of the fluid contained within the tank, it is desirable to thoroughly mix the added water with the ink while avoiding the formation of excessive frothing or foam within the fluid mass Also, as the ink level in the tank decreases from use of the ink, it is desirable to continually wipe adherent fluids from the walls of the tank so as to prevent such fluids from congealing or desiccating on the walls of the tank. Accordingly, a single device which is capable of carrying out both of these functions would provide a substantial advancement in the art.

In response to this present need in the art, the invention described and claimed herein embodies an improved method and apparatus for agitating tank fluids and preventing the buildup of adherent fluids on the inner walls of the tank.

SUMMARY OF THE INVENTION

The present invention provides a novel agitator apparatus which, when installed within a fluid containing tank, may be rotated to achieve the desired low froth agitation of the tanked fluid while, at the same time, removing adherent fluid from the walls of the tank. The apparatus generally comprises a rotational agitating means disposed within the tank and having one or more tank wall wiper blades attached thereto so as to continuously wipe or skim fluid from the tank wall as the agitator means rotates within the tank.

Further in accordance with the invention, there is provided an agitator apparatus comprising a rotatable shaft member positioned within a tank and having at least one perforated panel connected to and extending laterally therefrom. The perforated panel is positioned relative to the shaft such that rotation of the shaft will cause the panel to move through the fluid with quantities of such fluid flowing through a multiplicity of perforations or apertures which extend through the panel.

Still further in accordance with the invention, an agitator device for rotationally mixing tanked fluids is provided with one or more tank wall wiper blades. Such tank wall wiper blades are connected to the rotational agitation means and positioned so as to maintain contact with the walls of the tank. Thus, as the agitation means is rotated the wiper blades will skim, wipe or otherwise separate fluid from the walls of the tank thereby returning such fluid to the fluid mass within the tank. Such controlled skimming, wiping or separation of fluid from the walls of the tank will assist in maintaining the desired physical and/or thermal homogeneity within the fluid mass while also preventing the buildup of adherent material on the walls of the tank above the present fluid level line. The rotational agitation means may comprise perforated mixing panels connected to and extending outwardly from a rotating central shaft.

In accordance with an even still further aspect of the invention, a rigid perpendicular crossbar may be attached near the base of the central shaft so as to extend laterally on either side thereof. The bottom edges of the perforated mixing panels and the bottom ends of a pair of lateral tank wall wiper blades are then directly welded or otherwise firmly attached to the rigid crossbar so as to extend vertically upward therefrom. By such arrangement, the tank wall wiper blades are held rigidly in contact with the tank wall. Also, there is maintained a constant spatial relationship between the outer tank wall wiping blades and the inner perforated mixing panels. Furthermore, the rigid crossbar acts as a brace to prevent the perforated mixing panels from bending or distorting as they move through dense or viscous liquids.

Even further in accordance with the invention there is provided a method of operating the fluid agitation devices of the foregoing character. The inventive method of operation further aids in using the agitator device of the present invention to accomplish the desired thermal and/or physical homogeneity of the fluid while preventing the formation of excessive froth or foam within the fluid mass. The presently preferred method comprises rotating the device in alternate 180-degree clockwise-counterclockwise movements. Such alternating 180-degree movements may be punctuated by quiescent intervals of predetermined duration during which the agitation device will remain idle. The resultant pulsed or intermittent rotational movement of the device will be carried out at a rate which is sufficient to achieve the desired physical or thermal homogeniety of the fluid mass and the desired prevention of fluid buildup on the walls of the tank. At the same time, however, the rate of such pulsed or intermitant movements of the agitator will be minimized so as to limit the amount of air or surrounding gas that is pulled into the fluid mass and the resultant undesirable formation of froth and/or foam.

Still further in accordance with the invention the method of operating the fluid agitation devices of the foregoing character may include a fully or partially automated continuous or intermittent rotation of the device for predetermined time periods following the addition of any desired diluent or secondary ingredient so as to thoroughly mix such ingredient into the fluid mass. For example, in a flexographic printing ink process, it is generally necessary to control the viscosity of ink contained within an ink conditioning tank through the periodic addition of water to the ink. In such application, the fluid agitation device is operatively associated with a controller means which will trigger the device to continually or intermittently rotate within the tank upon the addition of water. The agitator will then continue to run for a brief period thereafter, until the vicosity of the fluid within the tank has become homogenous and within the desired range. It should be appreciated that the intermittent pattern of 180-degree rotations which may be employed for the purpose of routinely maintaining homogeneity of the water-ink mixture may also be effective to accomplish the periodic mixing of the diluent water into the ink. Alternatively, a wholly different pattern of operation may be employed when adding and blending the second fluid within the fluid mass already present in the tank.

A principal object of the invention is to provide a apparatus for effecting low froth agitation of tank fluids.

A further object of the invention is to provide an agitation apparatus which includes a tank wall wiping means capable of preventing the tanked fluids or residues, extracts, and reaction products thereof from congealing, drying, caking, or desicating on the tank walls at points above or below the fluid level line within the tank.

A further object of the invention is to provide a method for operating the agitator devices of the foregoing character in a manner which will maintain the desired physical and/or thermal homogeneity of the fluid while at the same time minimizing the likelihood of excessive frothing within the tank due to over-agitation of the fluid.

Further objects and advantages of the invention will become apparent to those skilled in the art upon reading and consideration of the following description of a preferred embodiment and the accompanying drawings.

DETAILED DESCRIPTION OF A PREFERRED EMBODIMENT

Figure 1:
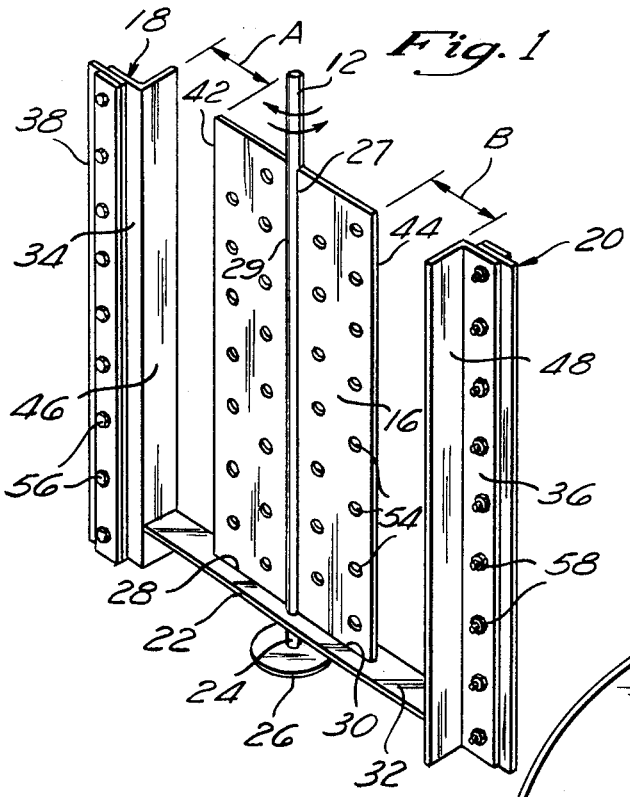
FIG. 1 is a perspective view of a preferred fluid agitator apparatus of the present invention incorporating tank wall wiper blades.

Referring now to the drawings wherein the showings are purposes of illustrating a preferred embodiment of the invention and not for purposes of limiting its scope, FIG. 1 shows a perspective view of a fluid agitation device which may be positioned within a fluid-filled tank and rotated so as to achieve low froth agitation of the fluid while simultaneously skimming adherant fluid from the tank wall thereby preventing such fluid from congealing, drying, solidifying, desicating, caking, or otherwise undergoing physical changes due to prolonged contact with the tank wall.

As shown in FIG. 1, a cylindrical central shaft member 12 extends vertically upward at the axial center of the device. Perforated mixing panels 14 and 16 are connected to and extend laterally from opposite sides of the cylindrical shaft 12. Tank wall wiper blades 18 and 20 are positioned radially outward of the perforated mixing panels 14 and 16 and are held in generally parallel vertical alignment therewith. Open spaces or voids A and B exist between the laterally positioned tank wall wiper blades 18 and 20 and the perforated mixing panels 14 and 16, respectively.

The structural integrity and rigidity of the agitator device 10 is owed in part to the provision of a cross member 22 positioned at the base of shaft 12 which is preferably fabricated having an L-shaped cross-sectional configuration. The angular cross member 22 is provided with an annular aperture through which the cylindrical shaft member 12 extends. A short basal extension 24 of the cylindrical shaft 12 extends below the cross member 22, and is pivotally connected to the floor of the tank so as to form a rotational pivot axis upon which the device may rotate.

A large washer 26 abuts the bottom edge of the angular cross member 22 and, along with the cross member 22 itself, is firmly affixed as by welding to the central shaft member 12 thereby forming a rigid unitary support structure. Because the central shaft 12 and cross member 22 are so joined, rotation of the vertical shaft 12 will cause corresponding rotational movement of the horizontal cross member 22.

The bottom edges 28 and 30 of perforated mixing panels 14 and 16 are rigidly affixed to the upper surface 32 of cross member 22 as shown. Likewise, the inner edges 27, 29 of the perforated mixing panels 14 and 16 are joined to either side of the vertical shaft 12. By such arrangement, the mixing panels are held in rigid vertical alignment with the shaft member 12.

The bottom ends of tank wall wiper assemblies 18 and 20 are welded to either end of the cross member 22, such that the wiper blade assemblies 18 and 20 extend vertically upward therefrom. Thus, the wiper blade assemblies 18, 20 are provided with a firm connection between the central shaft member 12 and the vertical wiper blades 18 and 20 such that rotational movement of the central shaft member 12 will result in controlled movement of the wiper blades 18 and 20 along the surrounding tank walls.

The tank wall wiper blade assemblies 18 and 20 each comprise a vertically disposed angle member 34, 36 having a rubber squeegee blade 38, 40 attached thereto such that the squeegie blade 38, 40 will maintain continuous contact with the tank wall. By such arrangement, the squeegee blade will serve to separate fluid from contact with the tank wall upon rotational movement of the device.

Figure 3:
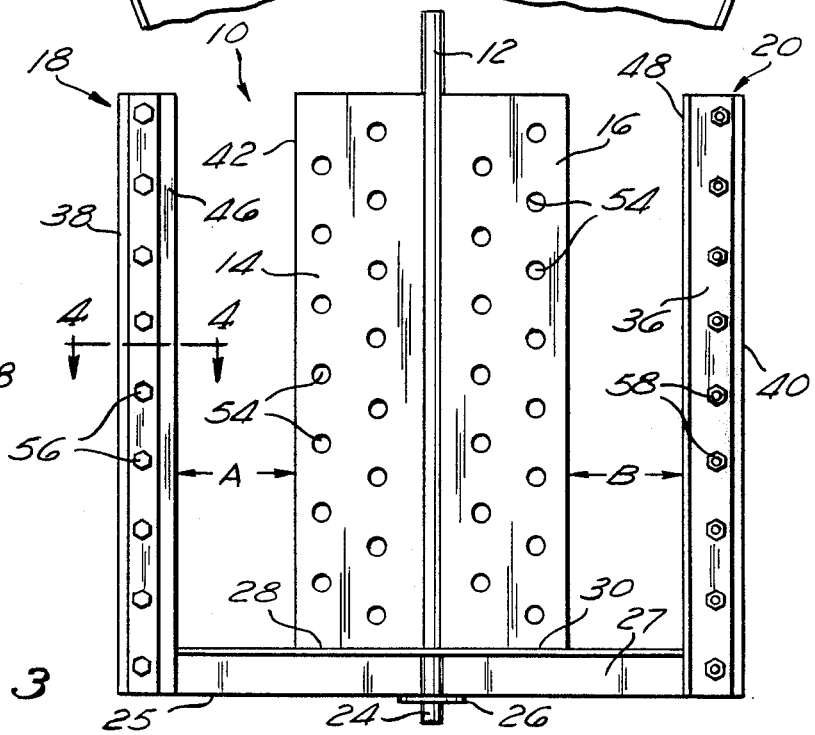
FIG. 3 is a top plan view of the fluid agitator apparatus of claim 1.

The positioning of the device 10 within a fluid holding tank may be fully appreciated from a the top plan view of FIG. 3. Referring to FIG. 3, the device 10 is rotationally mounted within a surrounding cylindrical tank wall 50. The vertical shaft member 12 stands vertically at the center axis of the tank 50. Cross member 22 emanates perpendicularly from either side of shaft 12. Wiper assemblies 18 and 20 are connected to and extend vertically from the opposite ends of cross member 22 such that the squeegee blades 38 and 40 of wiper assemblies 18 and 20 will be held in direct contact with the cylindrical outer tank wall 50.

The perforated mixing panels 14 and 16 also extend laterally from the central shaft member 12. Open spaces A and B exist between the outer edges 42, 44 of mixing panels 14 and 16 and the inner edges 46, 48 of tank wall wiper assemblies 18 and 20, respectively.

Referring to the elevational view of FIG. 3, the inner edges of mixing panels 14 and 16 are connected to either side of vertical shaft 12 while the bottom edges 28, 30 of panels 14 and 16 are connected to supporting member 22. Each mixing panel 14, 16 is provided with a multiplicity of annularapertures extending therethrough in an evenly spaced, staggered, or zigzag array as shown. Each such aperture 54 is preferably sized having a 1 inch diameter so as to allow fluid flow therethrough during rotational movement of the device, however variation in aperture size for differing mixing applications is contemplated.

Figure 4:
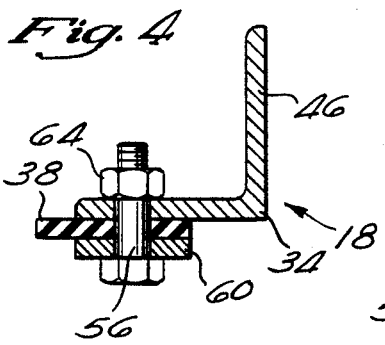
FIG. 4 is an enlarged plan view of one tank wall wiper blade which forms a part of the fluid agitation apparatus of the present invention as shown in FIG. 3.

FIG. 4 shows a cross-section of the tank wall wiper assembly 18 taken through line 4—4 of FIG. 3. A standard section of metal angle member 34 is cut to a length which corresponds to the vertical height of the inner tank wall. The section of angle member 34 is then provided with a multiplicity of evenly spaced, linearly aligned bolt receiving apertures A squeegee blade 38 made of flexible rubber or similar material is provided with a corresponding multiplicity of apertures sized and spaced to align directly with those of the angle iron 34. A retaining flat bar section 60 is, accordingly, provided with the same array of apertures such that the bolt receiving holes of the angle iron 34, the squeegie wiper blade 38, and the retaining flat bar 60 may be directly aligned with one another as these elements are placed in vertical juxtaposition.

Bolts 56 are passed through the apertures and corresponding nuts 64 are threaded onto the bolts so as to tightly hold the angle 34, wiper blade 38, and retaining flat bar 60 in the desired configuration, as depicted in FIG. 5.

Figure 2:
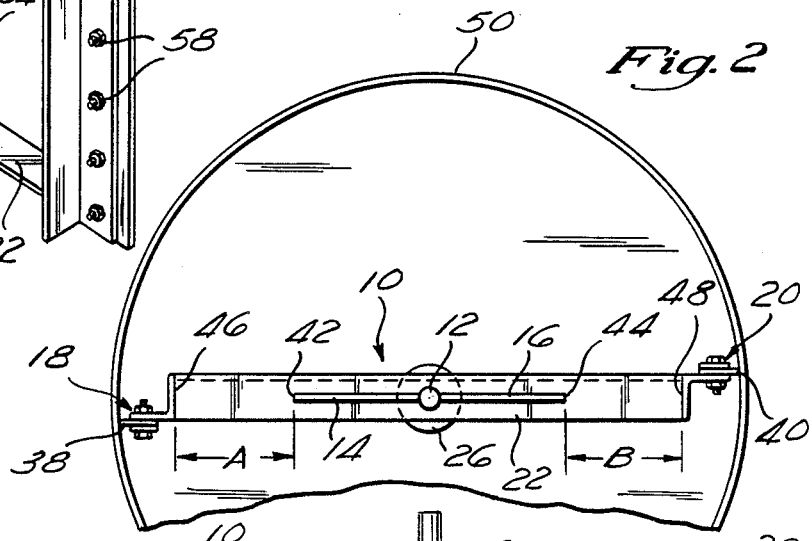
FIG. 2 is an elevational view of a portion of the fluid agitator apparatus of FIG. 1.

As shown in FIG. 4, the tank wall wiper assembly 18 is firmly connected to the supporting cross-member 22 such that the outer edge of wiper blade 38 will directly contact the inner wall of the holding tank. In embodiments where more than one tank wall wiper blade is used, such as the preferred embodiment depicted in FIGS. 1–3, it may be desirable to position the angles 34 and 36 so that the legs 46, 48 of the angles are directed in opposite directions as may be fully appreciated from the plan view of FIG. 2.

Operation of the Preferred Embodiment

In accordance with the present invention, an agitator device of the present invention such as the preferred embodiment depicted in FIGS. 1–4 may be operated by intermittent or pulsed clockwise/counterclockwise 180-degree rotations. In accordance with the inventive method, the device 10 is initially rotated 180 degrees clockwise by way of central shaft, then permitted to stand idle for a predetermined period. After the predetermined standing period has expired, the device 10 is then rotated counterclockwise 180 degrees to its original starting position. After the original starting position has been reached, another predeteremined standing period is permitted to expire before the above-described sequence of 180-degree clockwise-counterclockwise movements is repeated.

Additionally, the device 10 may be operatively controlled by an electronic sensing-control means whereby the agitator device 10 will be automatically actuated when a sensor within the control means senses that the fluid within the tank is, for some reason, in need of agitation. For example, the sensor may comprise a thermocouple monitor which continually or periodically determines the temperature of the tanked fluid. When the temperature of the fluid has fallen below a desired point, the controller will trigger the agitator device to rotate while heat is applied to the tank jacket so as to ensure homogeneity of temperature and even warming of the tanked fluid to the desired temperature.

Another example, which is particular to flexographic printing ink applications, is the controlled addition of a diluent, such as water, for the purpose of reducing the viscosity of the ink within the tank. In such system, the controller incorporates a viscosimeter which continually monitors the viscosity of the ink within the tank. When the viscosity of the ink has fallen below a predetermined point, the controller will call for the infusion of water into the tank so as to reduce the viscosity of the ink contained therein. Upon the addition of water, the controller means will also trigger the agitator to begin its pulsed 180-degree semi-rotational movement. Such movement of the agitator will continue until the viscosimeter material within the tank (including the newly added water) has been thoroughly blended and has reached a desired homogenous viscosity. Thereafter, the controller means will signal the agitator device 10 to cease rotational movement. The agitator device 10 may return to a schedule of timed pulsed rotational movements sufficient to maintain even temperature and physical homogeneity of the ink while at the same time avoiding execessive physical disturbance of the fluid as would cause the formation of froth or other undesirable physical changes of the liquid associated with excessive or overly vigorous stirring.

Because the tank wall wiper assemblies 18 and 20 of the agitator device 10 serve to separate fluid from the inner wall of the tank both above and below the upper surface of the fluid, the rotational movement of these wiper blade assemblies 18, 20 will achieve a two-fold purpose. First, provided that the wiper blade assemblies are sized to extend vertically above the existing fluid level within the tank, they will serve to wipe away fluid which has remained on the walls of the tank above the present fluid level. Such adherent fluid may be left on the walls of the tank as the liquid level within the tank falls due to normal depletion of the liquid, or such adherent liquid may result from splashing of the liquid above the present liquid level and onto the tank wall. If the fluid which remains on the wall of the tank is not removed by the wiper blades, it may tend to desicate and cake on the walls of the tank, thereby providing a potential source for particulate contamination of the fluid and also presenting a severe cleanup problem. By continually wiping the adherent fluid from the wall of the tank, the agitator device of the present invention will keep the tank walls free of adherent fluids and will thereby prevent the desication and buildup of dried material on the walls of the tank.

Also, the portions of the tank wall wiper assemblies 18 and 20 which extend below the existing upper liquid surface of the fluid will serve to disrupt any laminar layer of fluid which may be statically positioned directly next to the tank wall, thereby providing for optimal homogeneity and mixing of the entire mass of fluid within the tank.

It is to be understood that the exemplary method and apparatus described herein and shown in the drawings represents only a presently preferred embodiment of the invention. Indeed, various modifications and additions may be made to such embodiment without departing from the spirit and scope of the invention. For example, the size and shape of the mixing panels 14 and 16 may be varied in accordance with the particular application. Likewise, the numerosity, positioning, and shape of the individual apertures 54 which extend through the perforated mixing panels 14 and 16 may be varied and, indeed, the shape of such apertures need not be limited to the round configuration shown in the drawings. Also, the various component parts of the device 10, including the tank wall wiping assemblies 18 and 20, may be formed of single-piece molded plastic or any other type of material capable of carrying out the desired functions of the device. Additionally, the manner in which the mixing panels 14, 16 and the tank wall wiper assemblies 18, 20 are held in their desired positions may be achieved by many different structural means incorporating any system of braces, interconnections, or support members capable of rigidly holding these elements in their desired positions. Thus, these and other modification and additions may be obvious to those skilled in the art and may be implemented to adapt the present invention for use in a variety of different applications.

What is claimed is:

1. A fluid mixing and tank wall wiping device positionable within a holding tank having an inner wall surface, said device comprising:

a vertical shaft member positionable at a first location within said holding tank and operative to undergo at least partial rotational movement therewithin;

at least one perforated panel having an upper edge, a lower edge, an inner edge, an outer edge, and a plurality of apertures extending therethrough, said panel being positioned such that the inner edge thereof is in alignment with at least a portion of said vertical shaft, said panel being thereby disposed in a vertical plane which extends laterally from said vertical shaft;

at least one elongate tank wall wiper blade, each said elongate wiper blade being positioned laterally outboard of, and held a fixed distance from the outer edge of a selected perforated panel, thereby defining a void between each selected perforated panel and its corresponding tank wall wiper blade positioned laterally outboard thereof; and means for operatively connecting (a) said vertical shaft, (b) said at least one perforated panel, and (c) said at least one wiper blade, such that rotational movement of the vertical shaft member will result in corresponding rotational movement of said at least one panel and said at least one wiper blade;

said mixing assembly being sized and configured so that, when said vertical shaft is positioned at said first location within said holding tank, said at least one wiper blade will be in contact with the inner wall surface and upon said rotational movement thereof, will travel along said inner wall surface to separate liquid therefrom.

2. The device of claim 1 wherein said inner wall surface is generally cylindrical in configuration.

3. The device of claim 1 wherein said shaft member comprises a generally cylindrical rod.

4. The device of claim 1 wherein said first location is at the approximate center of said holding tank.

5. The device of claim 1 wherein said apertures which extend through said perforated panel comprise a multiplicity of round holes.

6. The device of claim 5 wherein said round holes are arranged on each of said perforated panels in a staggered zig-zag array.

7. The device of claim 1 wherein said tank wall wiper blade is incorporated into a tank wall wiper blade assembly, said assembly comprising:

an angular member;

a plurality of bolt receiving apertures extending through said angular member;

a flexible wiper blade having a plurality of bolt receiving apertures spaced to correspond and align with the bolt receiving apertures of said angular member;

a flat bar retainer having a plurality of bolt receiving apertures extending therethrough, said bolt receiving apertures of said flat bar retainer being spaced to correspond and align with the bolt receiving apertures of said wiper and said angular member;

said flexible wiper blade being positioned between said section of metal angle and said flat bar retainer with the bolt receiving apertures of said angular member, said flexible wiper blade and said flat bar retainer being positioned in alignment with one another and having bolts extending therethrough so as to form a unitary wiper blade assembly.

8. The device of claim 1 wherein:

said at least one perforated panel comprises first and second perforated panels disposed on opposite sides of said vertical shaft member; and said at least one elongate tank wall wiper blade comprises first and second elongate tank wall wiper blades, said first elongate tank wall wiper blade being positioned laterally outboard of said first perforated panel and said second elongate tank wall wiper blade being positioned laterally outboard of said second perforated panel.

9. The device of claim 8 wherein said means for rigidly connecting said vertical shaft, said at least one panel, and said at least one wiper blade comprises a rigid member connected to and extending perpendicularly from said vertical shaft member.

10. The device of claim 9 wherein said means for operatively connecting said vertical shaft, said first and second perforated panels, and said first and second wiper blades comprises a rigid cross member attached to and extending perpendicularly to and in opposite lateral directions from said vertical shaft member.

11. The device of claim 10 wherein said vertical shaft member has an upper end and a lower end and wherein said rigid cross member is attached to said vertical shaft member near the lower end thereof and further wherein the lower edges of said first and second perforated panels and said first and second wiper blades are attached to and extend upwardly from said rigid cross member.

12. The device of claim 11 wherein said void defined between each selected perforated panel and its corresponding tank wall wiper blade positioned laterally outboard thereof comprises:

a generally rectangular open space having first, second and third edges bordered by (a) said tank wall wiper blade, (b) said rigid cross member, and (c) said outer edge of said selected perforated mixing panel, respectively.

13. The device of claim 11 wherein said rigid cross member comprises a section of angle iron.

14. The device of claim 11 wherein additionally, the inner edges of said perforated mixing panels are joined to said vertical shaft.

* * * * *